US010068754B2

(12) United States Patent
Wildgoose

(10) Patent No.: US 10,068,754 B2
(45) **Date of Patent: *Sep. 4, 2018**

(54) METHOD OF IDENTIFYING PRECURSOR IONS

(71) Applicant: MICROMASS UK LIMITED, Wilmslow (GB)

(72) Inventor: Jason Lee Wildgoose, Stockport (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

This patent is subject to a terminal disclaimer.

(21) Appl. No.: 15/283,863

(22) Filed: Oct. 3, 2016

(65) Prior Publication Data

US 2017/0125224 A1 May 4, 2017

Related U.S. Application Data

(63) Continuation of application No. 14/401,228, filed as application No. PCT/GB2013/051199 on May 9, 2013, now Pat. No. 9,460,902.

(Continued)

(30) Foreign Application Priority Data

May 18, 2012 (GB) ..... 1208961.1

(51) Int. Cl.
*H01J 49/00* (2006.01)
*H01J 49/40* (2006.01)

(52) U.S. Cl.
CPC ..... *H01J 49/0045* (2013.01); *H01J 49/0031* (2013.01); *H01J 49/40* (2013.01)

(58) Field of Classification Search
None
See application file for complete search history.

(56) References Cited

U.S. PATENT DOCUMENTS 6,717,130 B2 * 4/2004 Bateman ..... H01J 49/0045 250/281
6,992,283 B2 1/2006 Bateman et al.
(Continued)

FOREIGN PATENT DOCUMENTS

JP 2005166639 6/2005

OTHER PUBLICATIONS

Wang H. et al., "Qit-q-Tof Mass Spectrometer for Two-Dimensional Tandem Mass Spectrometry", Rapid Communications in Mass Spectrometry, US John Wiley & Sons, vol. 21, No. 19, pp. 3223-3226, Oct. 2007.

*Primary Examiner* — Michael Logie

(57) ABSTRACT

A method of mass spectrometry is disclosed comprising mass selectively transmitting precursor ions from a mass analyzer into a fragmentation or reaction device, wherein the mass to charge ratios of the ions transmitted varies with time; fragmenting the precursor ions in the fragmentation or reaction device so as to produce fragment or product ions; mass analyzing the fragment or product ions; determining the start and end times at which a first fragment or product ion is detected; using said start and end times to determine the start and end times at which a precursor ion of said first fragment or product ion is transmitted by said mass analyzer; and using the start and end times at which the precursor ion is transmitted by said mass analyzer to determine a mass to charge ratio of said precursor ion. The present invention enables precursor ion peaks to be resolved from the fragment data even when a low resolution mass analyzer is used to analyze the precursor ions.

13 Claims, 1 Drawing Sheet

Related U.S. Application Data

(60) Provisional application No. 61/649,998, filed on May 22, 2012.

(56) References Cited

U.S. PATENT DOCUMENTS

| | | | | |
|---|---|---|---|---|
| 8,809,062 | B2 * | 8/2014 | Gorenstein | G01N 30/72 422/82.05 |
| 8,809,768 | B2 | 8/2014 | Bateman et al. | |
| 9,460,902 | B2 * | 10/2016 | Wildgoose | H01J 49/0031 |
| 2004/0041091 | A1 * | 3/2004 | Bateman | H01J 49/0031 250/282 |
| 2009/0014639 | A1 | 1/2009 | Bateman | |
| 2009/0179149 | A1 * | 7/2009 | Sugiyama | H01J 49/0045 250/282 |
| 2010/0301205 | A1 * | 12/2010 | Thomson | H01J 49/0027 250/283 |
| 2011/0184648 | A1 * | 7/2011 | Gorenstein | G01N 30/72 702/19 |
| 2011/0226941 | A1 * | 9/2011 | Gorenstein | G01N 30/7233 250/282 |
| 2012/0126110 | A1 | 5/2012 | Green et al. | |
| 2012/0241602 | A1 * | 9/2012 | Goshawk | H01J 49/0027 250/282 |
| 2013/0334415 | A1 | 12/2013 | Sugawara et al. | |
| 2014/0038216 | A1 * | 2/2014 | Gorenstein | G01N 30/72 435/23 |
| 2016/0254129 | A1 * | 9/2016 | Richardson | H01J 49/0031 250/282 |

* cited by examiner

METHOD OF IDENTIFYING PRECURSOR IONS

CROSS-REFERENCE TO RELATED APPLICATION

This application is a continuation of U.S. patent application Ser. No. 14/401,228, which is the National Stage of International Application No. PCT/GB2013/051199, filed 9 May 2013, which claims priority from and the benefit of U.S. Provisional Patent Application Ser. No. 61/649,998 filed on 22 May 2012 and United Kingdom Patent Application No. 1208961.1 filed on 18 May 2012. The entire contents of these applications are incorporated herein by reference.

BACKGROUND OF THE PRESENT INVENTION

It is known to employ Data Dependant Acquisitions ("DDA") on a tandem mass spectrometer, such as a quadrupole-Time of Flight mass spectrometer ("Q-ToF"). According to such known techniques, the mass to charge ratios of parent or precursor ions are determined in a survey scan. The quadrupole mass filter then sequentially isolates each individual parent or precursor ion according to its mass to charge ratio and accelerates it into a collision cell to produce product ions. The product ions are then mass analysed in the Time of Flight mass analyser. However, when the parent or precursor ions are isolated the other parent or precursor ions are discarded, leading to a low duty cycle. Furthermore, the parent or precursor ion selection according to this technique results in some bias. For example, if the 20 most intense precursor ions are selected this will bias the data towards the most abundant species.

An improvement on this approach was disclosed in U.S. Pat. No. 6,717,130 (Micromass), wherein precursor ions are not isolated and selected but fragment ions are assigned to parent ions by correlating their detection times to the times as which the parent species eluted from the chromatography column. This technique improves the duty cycle of the instrument and minimises biased acquisitions. However, the technique suffers from specificity limitations since at the point of fragmentation the parent ions are only separated from each other by chromatography.

A known mode of operation of a quadrupole-Time of Flight mass spectrometer is to operate the quadrupole mass filter in a low resolution mode with a transmission window of, for example, 25 Da. The mass to charge ratio range of the ions transmitted by the quadrupole mass filter is then sequentially incremented in steps of approximately 25 Da and in a manner that is not data dependant. Ions exiting the quadrupole mass filter are accelerated into a gas cell and the resulting fragment ions are mass analysed by the Time of Flight mass analyser. The data from each 25 Da window is kept separate for processing. This technique is un-biased in the nature of the acquisition and has an improved duty cycle over devices operating with narrower mass to charge ratio isolation windows. However, the technique has limited precursor ion specificity because any given fragment ion may belong to any of the precursor ions transmitted within a 25 Da window.

It is therefore desired to provide and improved method of mass spectrometry and an improved mass spectrometer.

SUMMARY OF THE PRESENT INVENTION

According to a first aspect of the present invention there is provided a method of mass spectrometry comprising:

mass selectively transmitting precursor ions from a mass analyser into a fragmentation or reaction device, wherein the mass to charge ratios of the ions transmitted varies with time;

fragmenting the precursor ions in the fragmentation or reaction device so as to produce fragment or product ions;

mass analysing and detecting the fragment or product ions;

determining the start and end times at which a first fragment or product ion is detected;

using said start and end times to determine the start and end times at which a precursor ion of the first fragment or product ion was transmitted by the mass analyser; and using said start and end times at which the precursor ion was transmitted by the mass analyser to determine a mass to charge ratio of the precursor ion.

The present invention uses data determined from the analysis of fragment or product ions in order to determine the mass to charge ratios of precursor ions transmitted by the mass analyser. As such, the mass to charge ratios of the precursor ions can be determined with relatively high specificity even when a relatively low resolution precursor ion mass analyser is used. As the technique enables a relatively low resolution mass analyser to be used, mass filter mass analysers may be used whilst still maintaining a relatively high duty cycle. In particular, the duty cycle of the mass spectrometer may be improved since the low resolution mass filter rejects fewer precursor ions at any given time. Preferably, the mass to charge ratios of precursor ions transmitted by the mass analyser is scanned or stepped with time according to a scan function. The scan function and said start and end times at which the precursor ion was transmitted may then be used to determine the mass to charge ratio of said precursor ion.

The method preferably further comprises determining the start and end times at which a second fragment or product ion is detected; using these start and end times to determine the start and end times at which a precursor ion of the second fragment or product ion is transmitted by the mass analyser; and using the start and end times at which this precursor ion is transmitted by the mass analyser to determine a mass to charge ratio of this precursor ion.

Although methods are described herein for determining mass to charge ratios of two precursor ions from fragment ion data, it is contemplated that the mass to charge ratios of third, fourth, fifth, sixth and further precursor ions may be determined from their fragment ion data by corresponding techniques to those discussed herein.

Preferably, the time period over which the first fragment or product ion is detected only partially overlaps with the time period over which the second fragment or product ion is detected. This may indicate that the time period over which the mass analyser transmits the precursor ions of the first fragment or product ions overlaps with the time period over which the mass analyser transmits the precursor ions of the second fragment or product ions. Although it may not be possible to resolve these precursor ions if the precursor ions leaving the mass analyser where detected directly, the precursor ions are able to be resolved by using data relating to the times at which their fragment or product ions are detected.

The method may further comprise determining that at least one additional fragment or product ion is detected with the same start and end times at which the first fragment or product ion is detected before using the start and end times of the first fragment or product ion to determine the start and end times at which a precursor ion of the first fragment or product ion is transmitted by the mass analyser. The method may additionally comprise determining that at least one additional fragment or product ion is detected with the same start and end times at which the second fragment or product ion is detected before using the start and end times of the second fragment or product ion to determine the start and end times at which a precursor ion of the second fragment or product ion is transmitted by the mass analyser. These additional fragment or product ions can be determined as being fragment or product ions that have been detected as having a different mass to charge ratio to the first and/or second fragment or product ions.

The method preferably comprises using the start and end times at which the precursor ion of the first fragment or product ion is transmitted by the mass analyser to determine first lower and upper mass to charge ratio limits for this precursor ion. Additionally, or alternatively, the method may comprise using the start and end times at which the precursor ion of the second fragment or product ion is transmitted by the mass analyser to determine second lower and upper mass to charge ratio limits for this precursor ion.

A mass to charge ratio centroid value may be determined for the precursor ion of the first fragment or product ion from the first lower and upper mass to charge ratio limits. Alternatively, or additionally, a mass to charge ratio centroid value may be determined for the precursor ion of the first fragment or product ion from the second lower and upper mass to charge ratio limits.

The method may comprise identifying the precursor ions from the mass to charge ratios determined for the precursor ions.

The method may comprise identifying the fragment or product ions from the mass to charge ratios determined for the fragment or product ions. The technique of the present invention may be used to correlate the fragment or product ions to their respective precursor ions. This may be used to identify the precursor ions.

The method may comprise continuously or repeatedly fragmenting precursor ions in the fragmentation or reaction device so as to produce the fragment or product ions; and continuously or repeatedly mass analysing the fragment or product ions.

The start and end times at which the first fragment or product ion is detected may be substantially the same as the start and end times at which the precursor ion of the first fragment or product ion is transmitted by the mass analyser. Similarly, the start and end times at which the second fragment or product ion is detected may be substantially the same as the start and end times at which the precursor ion of the second fragment or product ion is transmitted by the mass analyser.

Preferably, the mass to charge ratios of the precursor ions transmitted into the fragmentation or reaction device is scanned continuously with time or stepped with time.

The precursor ions are preferably transmitted to the fragmentation or reaction device by a low resolution mass analyser and the fragment or product ions are preferably mass analysed by a high resolution mass analyser.

The mass analyser that transmits the precursor ions to the fragmentation or reaction device may be a mass filter. The mass analyser may be a quadrupole mass filter or another multipole mass filter. Alternatively, other types of mass filter or mass analyser may be employed. For example, the mass analyser may be an ion trap and precursor ions may be caused to mass selectively exit the ion trap in a scanned or stepped manner. Alternatively, a scanning or stepped magnetic sector may be used. Alternatively, a long flight time Time-of-Flight mass analyser may be used to separate the precursor ions and provide them to the fragmentation or reaction device for fragmentation. According to a less preferred embodiment, the mass analyser may be a device with mass correlated separation such as an ion mobility separator.

Preferably, the mass analyser for mass analysing the fragment or product ions is a time of flight mass analyser. However, it is contemplated that other relatively high resolution mass analysers may be used to analyse the fragment or product ions.

The method may be operated in a second mode of operation, wherein one or more scans is performed in which precursor ions are detected rather than being fragmented. These unfragmented precursor ions may be used to calibrate the scan of the mass analyser that mass selectively transmits precursor ions into the fragmentation or reaction device. Alternatively, the unfragmented precursor ions may be used to determine better mass accuracies of the precursor ions than the mass analyser.

Fragment ion data from multiple separate acquisitions or experimental runs may be combined in order to determine the mass to charge ratios of the precursor ions.

An ion mobility separator may be provided upstream or downstream of the mass analyser for mass selectively transmitting the precursor ions. The mass scan function of the mass analyser may be synchronised with the ion mobility cycle time, e.g. so that the mass analyser is scanned once for each ion mobility cycle.

An ion mobility separator may be provided upstream or downstream of the mass analyser for mass selectively transmitting the precursor ions. The mass analyser may have a mass transmission window that is varied with time. The rate of scanning of the mass transmission window may be chosen so as to allow multiple ion mobility separator experiments for each precursor ion transmission window time. As such, an MS-IMS-MS nested data set may be provided.

The mass analyser for analysing the fragment or product ions may be a Time-of-Flight mass analyser and the method may operated in conjunction with established Time-of-Flight modes such as Enhanced Duty Cycle (EDC).

It is contemplated that the precursor ions may themselves be fragment ions.

The fragmentation or reaction device may be a gas cell into which the precursor ions are accelerated, or within which the precursor ions are accelerated, in order to fragment or react the ions to produce fragment or product ions. The present invention also contemplates other fragmentation or reaction methods such as, for example, electron transfer dissociation (ETD), electron capture dissociation (ECD) or surface induced dissociation (SID).

An ion trap that mass selectively releases precursor ions may be provided upstream of the mass analyser that mass selectively transmits the precursor ions. The scanning of the mass analyser may be synchronised with the mass to charge ratios of the precursor ions released from the ion trap. This arrangement increases the scanning duty cycle. The ion trap may be a poor resolution ion trap.

It is contemplated herein that the time it takes the scanned mass analyser of the precursor ions to perform an analytical cycle may be varied, and that the fragmentation energy may be varied as a function of the time it takes the scanned mass analyser of the precursor ions to perform an analytical cycle.

The device may be operated in a precursor ion discovery or neutral loss type mode, wherein the Time of Flight performance is optimised for a particular fragment ion or group of fragment ions. The chosen fragment ions maybe varied as a function of MS1 time.

The present invention also provides a mass spectrometer comprising:

a fragmentation or reaction device;

a first mass analyser for mass selectively transmitting precursor ions into the fragmentation or reaction device;

a second mass analyser for mass analysing fragment or product ions produced by the fragmentation or reaction device; and a controller arranged and adapted to:

mass selectively transmit precursor ions from the first mass analyser into the fragmentation or reaction device, wherein the mass to charge ratios of the ions transmitted vary with time;

fragment the precursor ions in the fragmentation or reaction device so as to produce fragment or product ions;

mass analyse the fragment or product ions in the second mass analyser;

determine the start and end times at which a first fragment or product ion is detected;

use the start and end times to determine the start and end times at which a precursor ion of the first fragment or product ion was transmitted by the mass analyser; and use the start and end times at which the precursor ion was transmitted by the mass analyser to determine a mass to charge ratio of the precursor ion.

The mass spectrometer may be arranged and adapted to perform any one of the methods described herein above.

From a second aspect the present invention provides a method of mass spectrometry comprising:

mass selectively transmitting precursor ions into a fragmentation or reaction device; wherein first precursor ions having a first mass to charge ratio are transmitted into the fragmentation or reaction device over a first time-period and second precursor ions having a second mass to charge ratio are transmitted into the fragmentation or reaction device over a second time-period such that the time-periods overlap only in part;

fragmenting the precursor ions in the fragmentation or reaction device so as to produce fragment ions;

mass analysing the fragment ions;

determining first fragment ions and second fragment ions having different mass to charge ratios and which are produced over different time-periods that overlap only in part;

determining that the first fragment ions relate to the first precursor ions and that the second fragment ions relate to the second precursor ions by determining that the end points of the first time-period substantially coincide with the end-points of the time-period over which the first fragment ions are determined to have been generated, and that the end points of the second time-period substantially coincide with the end-points of the time-period over which the second fragment ions are determined to have been generated; and identifying which precursor ions are the first precursor ions and which are the second precursor ions.

The first time-period is preferably used to identify the mass of the first precursor ions and/or the second time-period is preferably used to identify the mass of the second precursor ions.

The mass to charge ratios of the precursor ions transmitted into the fragmentation or reaction device is preferably scanned continuously with time or stepped with time.

A mass filter or mass analyser may be used to mass selectively transmit the precursor ions into the fragmentation or reaction device.

The mass to charge ratios transmitted by the mass filter or analyser may be scanned or stepped at a fast rate and a mass analyser analysing the fragments may be scanned or stepped so as to determine the mass to charge ratios of the fragment ions at a slow rate.

The precursor ions may be transmitted into the fragmentation or reaction device by a low resolution mass filter or mass analyser and the fragment ions may be mass analysed by a high resolution mass analyser.

The precursor ions may be separated by ion mobility separation prior to being mass selectively transmitted into the fragmentation or reaction device.

The present invention also provides a mass spectrometer comprising:

a fragmentation or reaction device;

means for mass selectively transmitting precursor ions into the fragmentation or reaction device; wherein first precursor ions having a first mass to charge ratio are transmitted into the fragmentation or reaction device over a first time-period and second precursor ions having a second mass to charge ratio are transmitted into the fragmentation or reaction device over a second time-period such that the time-periods overlap only in part;

means for fragmenting the precursor ions in the fragmentation or reaction device so as to produce fragment ions;

means for mass analysing the fragment ions;

means for determining first fragment ions and second fragment ions having different mass to charge ratios and which are produced over different time-periods that overlap only in part;

means for determining that the first fragment ions relate to the precursor ions and that the second fragment ions relate to the second precursor ions by determining that the end points of the first time-period substantially coincide with the end-points of the time-period over which the first fragment ions are determined to have been generated, and that the end points of the second time-period substantially coincide with the end-points of the time-period over which the second fragment ions are determined to have been generated; and identifying which precursor ions are the first precursor ions and which are the second precursor ions.

The mass spectrometer may be arranged and configured to perform any of the methods described in relation to the second aspect of the present invention.

The mass spectrometer of the first or second aspect of the present invention may comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; and (xxvi) a Solvent Assisted Inlet Ionisation ("SAII") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic or orbitrap mass analyser; (x) a Fourier Transform electrostatic or orbitrap mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and an Orbitrap® mass analyser comprising an outer barrel-like electrode and a coaxial inner spindle-like electrode, wherein in a first mode of operation ions are transmitted to the C-trap and are then injected into the Orbitrap® mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the Orbitrap® mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The preferred embodiment preferably comprises at least two different ion mass analysers and a fragmentation or reaction device placed between the two mass analysers. A first of the mass analysers may be a mass filter which is scanned so as to mass selectively transmit precursor ions to the fragmentation or reaction device. The second mass analyser may be a Time of Flight mass analyser for analysing the fragment or product ions produced by the fragmentation or reaction device. The fragment or product ions produced are preferably analysed at a much faster rate than the precursor ions. The times at which the fragment ions are detected may be used to determine the times at which their precursor ions were transmitted by the first mass analyser and hence may be used to determine the mass to charge ratios of the precursor ions.

The preferred embodiment operates by scanning a low resolution mass filter at a scan rate that allows multiple Time of Flight mass spectra to be acquired across the time of a scanned precursor ion mass spectral peak. The Time of Flight acquisition system may operate in a manner similar to that described in U.S. Pat. No. 6,992,283 (Micromass). In this mode each Time of Flight spectrum is tagged with its effective time or increment relative to some other start event. In the case of U.S. Pat. No. 6,992,283 the start event is the start of an ion mobility experiment. In the preferred embodiment the start event is the start of a low resolution mass scan of the precursor ions. The time at which fragment ion data is obtained can therefore be correlated to the low resolution scan of the precursor ions.

The precursor ion mass analyser is preferably of relatively low resolution and so has an improved duty cycle over conventional devices which isolate and transmit only a single precursor ion at once. Nevertheless, the use of the fragment or product ion data enables the preferred embodiment to maintain relatively high precursor ion specificity, i.e. improved mass measurement of the precursor ions, as compared with other known arrangements. The preferred embodiment improves the specificity of the precursor ions in an un-targeted, un-biased acquisition.

BRIEF DESCRIPTION OF THE DRAWINGS

Various embodiments of the present invention will now be described, by way of example only, and with reference to the accompanying drawings in which.

DETAILED DESCRIPTION OF THE PREFERRED EMBODIMENTS

Figure 1:
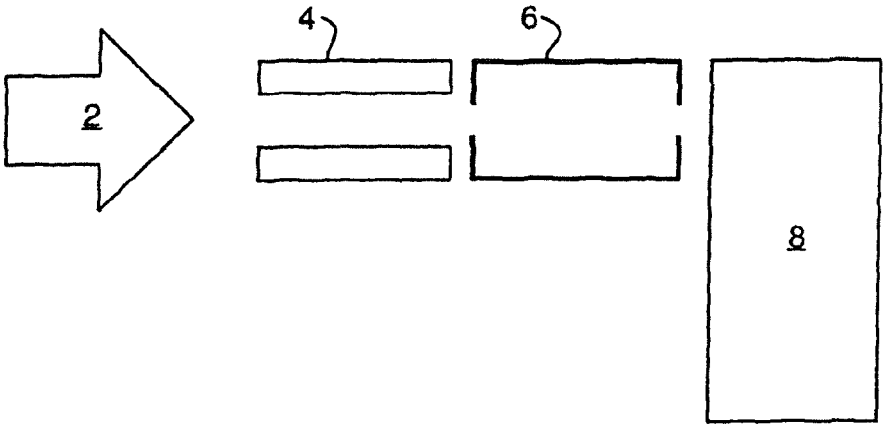
FIG. 1 shows a quadrupole Time of Flight mass spectrometer according to a preferred embodiment of the present invention.

FIG. 1 shows a schematic of a preferred embodiment of a mass spectrometer according to the present invention. The mass spectrometer comprises a quadrupole mass filter 4, a gas cell 6 and an orthogonal acceleration Time-of-Flight mass analyser 8. During operation, the quadrupole mass filter 4 is set so as to have a relatively low resolution. For example, the quadrupole 4 may transmit precursor ions 2 within a transmission window having a width of 25 Da. Precursor ions 2 that are transmitted by the quadrupole mass filter 4 are accelerated into the gas cell 6 such that they fragment to produce fragment ions. These fragment ions are then mass analysed in the Time-of-Flight mass analyser 8. The quadrupole mass filter 4 is scanned with time such that the range of mass to charge ratios of the transmission window changes with time. The timing at which fragment ions are detected may be correlated to the timing of the transmission window in which their precursor ions 2 were transmitted by the mass filter 4. The gas cell 6 preferably maintains the fidelity of the temporally separated fragment ions by use of a travelling wave or a linear accelerating electric field.

Figure 2A:
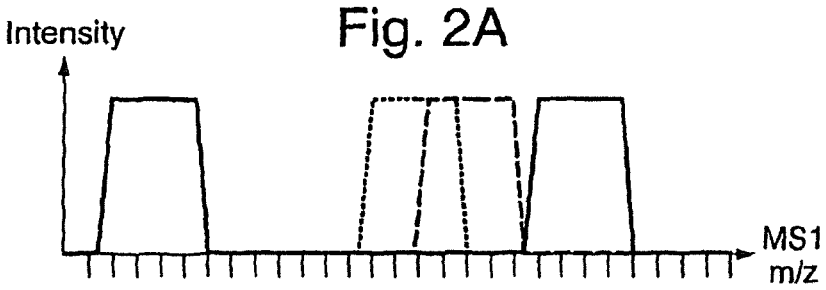
FIG. 2A shows a mass spectrum of precursor ions, wherein parent ion signals overlap.

FIG. 2A shows a graph representing precursor ions that may be transmitted by the quadrupole mass filter. The y-axis indicates the intensity of the ion signal and the x-axis indicates the mass to charge ratio of the ion signal. It will be appreciated that since the transmission window of the quadrupole mass filter is stepped with time, the x-axis is related to the time of analysis of the precursor ions. Each peak corresponds to a separate precursor ion species. If these precursor ions were transmitted by the quadrupole mass filter then the first and last peaks could be resolved by the quadrupole mass filter. However, the two central, dashed peaks would overlap and the low resolution of the quadrupole mass filter would not be able to resolve these two precursor ion peaks.

It may be desirable to use a relatively low resolution mass analyser, such as the quadrupole mass filter described above, because fewer precursor ions are then discarded at any given point in the mass analysis and so the duty cycle of the mass spectrometer is increased. However, this has conventionally been seen as detrimental in that the resolution of the instrument may be too low to resolve two similar precursor ion mass peaks. The present invention provides a technique for resolving such peaks that interfere with each other.

Figure 2B:
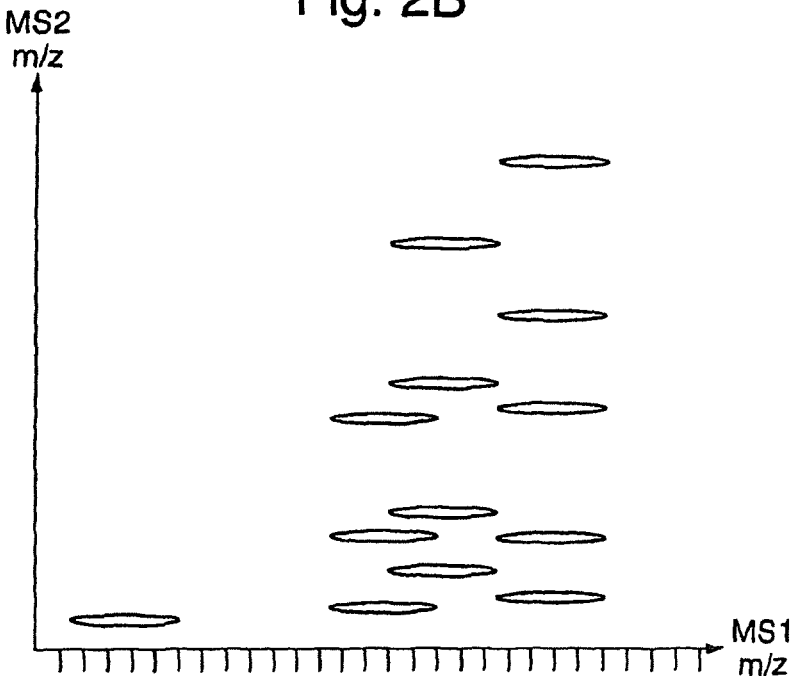
FIG. 2B shows a graph that illustrates how fragment ion signals may be used to resolve overlapping parent ion signals.

FIG. 2B shows a graph obtained from analysing the four precursor ions of FIG. 2A in accordance with the technique described above in relation to FIG. 1. The graph shows the mass to charge ratios of the fragment ions detected (y-axis), plotted as a function of the precursor ion mass to charge ratios transmitted by the quadrupole mass filter (x-axis). As mentioned above, the quadrupole mass filter is scanned with time and so the graph represents the mass to charge ratios of the fragment ions detected (y-axis), plotted as a function of time. It will be seen that the plots of the fragment ions are aligned in four columns and that all of the fragment ions were detected over four time windows. The first column, which contains only a single plot, corresponds to the fragment ion generated from the fragmentation of the precursor ion shown in the first peak of FIG. 2A. The second column, which contains three plots, corresponds to the three species of fragment ions generated from the fragmentation of the precursor ion shown in the second peak of FIG. 2A. The third column, which contains four plots, corresponds to the four species of fragment ions generated from the fragmentation of the precursor ion shown in the third peak of FIG. 2A. The fourth column, which contains five plots, corresponds to the five species of fragment ions generated from the fragmentation of the precursor ion shown in the fourth peak of FIG. 2A.

Although the precursor ions in FIG. 2A are not fully resolved and some of the peaks overlap, the fragment ions in FIG. 2B are well separated in mass to charge ratios (along the y-axis) and hence are well resolved. The start and end times at which a particular fragment ion is detected are correlated to the start and end times at which its precursor ion is transmitted to the gas cell for fragmentation. Accordingly, the start and end times of the fragment ion signals can be used to determine the start and end times of their corresponding precursor ion signals.

In the example shown in FIG. 2B, the first column of fragment ion plots has start and end times corresponding to the start and end times of an ion signal for a first precursor ion. The second column of fragment ion plots has start and end times corresponding to the start and end times of an ion signal for a second precursor ion. The third column of fragment ion plots has start and end times corresponding to the start and end times of an ion signal for a third precursor ion. The fourth column of fragment ion plots has start and end times corresponding to the start and end times of an ion signal for a fourth precursor ion. It will therefore be appreciated that this technique can be used to identify the start and end times of two precursor ion peaks that would overlap in a precursor ion spectrum obtained from a low resolution mass analyser, e.g. as shown as the dashed peaks in FIG. 2A.

Accordingly, the preferred embodiment is able to determine the start and end times of precursor ion peaks using data from the analysis of the fragment ions. Mass measurements can then be determined for these peaks more accurately. For example, the centroids of the mass peaks can be more accurately determined by knowing the start and end times of each of the peaks. This method of determining the masses of precursor ions is improved relative to known techniques of using a quadrupole that is scanned in 25 Da steps.

According to an example, a scanning quadrupole is operated at a scan rate of 10,000 Da per second over a mass to charge ratio range of 1000 Da. A single scan would therefore take approximately 100 ms. If the quadrupole is operated with a transmission window having a width of 25 Da then ions are transmitted in each mass to charge ratio window for 2.5 ms. If the Time-of-Flight mass analyser is operated at a cycle time of 100 μs then the mass analyser will take 25 samples during this period. If the mass to charge ratio is assumed to be uniformly distributed then it can be shown that the precision of the mass measurement according to the technique of the preferred embodiment is given by the following equation:

$$\sigma = \frac{7.2Da}{\sqrt{N}}$$

wherein N is the number of ions used to produce the apparent precursor ion peak profile and σ is the standard deviation. If 50 fragment ions were detected and used to produce the precursor ion peak profile then the standard deviation of the mass measurement would be approximately 1 Da according to the above equation. The nature of the quadrupole transmission window also means that the mass precision is bounded by +/−25 Da. These calculations take no account of any calibration error or residuals.

Although the present invention has been described with reference to preferred embodiments, it will be understood by those skilled in the art that various changes in form and detail may be made without departing from the scope of the invention as set forth in the accompanying claims.

For example, although a Time of Flight acquisition system has been described that operates in an asynchronous, time locked manner, the Time of Flight acquisition system may be synchronised with scan cycle of the quadrupole mass filter.

Although the mass transmission window has been described as having a width of 25 Da, the mass transmission window may have other widths. Furthermore, the width of the mass transmission window may be varied with time.

Although the mass transmission window has been described as having constant scan rate, the scan rate of the mass transmission window may be varied with time.

The mass transmission window of the mass filter is preferably stepped and the step size is preferably significantly smaller than the size of each mass transmission window.

The invention claimed is:

1. A method of mass spectrometry comprising:

mass selectively transmitting precursor ions from a mass analyser into a fragmentation or reaction device, wherein the mass to charge ratios of the ions transmitted varies with time;

fragmenting the precursor ions in the fragmentation or reaction device so as to produce fragment or product ions;

mass analysing and detecting the fragment or product ions;

determining a first time period over which a first fragment or product ion is detected;

determining, based on said first time period, a second time period at which a precursor ion of said first fragment or product ion was transmitted by said mass analyser, wherein the first time period substantially coincides with the second time period; and then determining, based on the second time period at which the precursor ion was transmitted by said mass analyser, a mass to charge ratio of said precursor ion.

2. The method of claim 1, further comprising determining a third time period over which a second fragment or product ion is detected; determining, based on the third time period, a fourth time period over which a precursor ion of said second fragment or product ion is transmitted by said mass analyser; and determining, based on the fourth time period at which this precursor ion is transmitted by said mass analyser, a mass to charge ratio of this precursor ion.

3. The method of claim 2, wherein the first time period over which the first fragment or product ion is detected only partially overlaps with the third time period over which the second fragment or product ion is detected.

4. The method of claim 1, further comprising identifying the precursor ions from the mass to charge ratios determined for the precursor ions.

5. The method of claim 1, wherein the mass to charge ratios of the precursor ions transmitted into the fragmentation or reaction device is scanned continuously with time or stepped with time.

6. The method of claim 1, wherein the precursor ions are transmitted to said fragmentation or reaction device by a low resolution mass analyser and said fragment or product ions are mass analysed by a high resolution mass analyser.

7. The method of claim 1, wherein the mass analyser that transmits the precursor ions to the fragmentation or reaction device is a mass filter.

8. The method of claim 1, wherein the mass analyser for mass analysing the fragment or product ions is a time of flight mass analyser.

9. A mass spectrometer comprising:

a fragmentation or reaction device;

a first mass analyser for mass selectively transmitting precursor ions into the fragmentation or reaction device;

a second mass analyser for mass analysing fragment or product ions produced by the fragmentation or reaction device; and a controller arranged and adapted to:

mass selectively transmit precursor ions from the first mass analyser into the fragmentation or reaction device, wherein the mass to charge ratios of the ions transmitted vary with time;

fragment the precursor ions in the fragmentation or reaction device so as to produce fragment or product ions;

mass analyse the fragment or product ions in the second mass analyser;

determine a first time period over which a first fragment or product ion is detected;

determine, based on said first time period, a second time period at which a precursor ion of said first fragment or product ion was transmitted by said mass analyser wherein the first time period substantially coincides with the second time period; and then determine, based on the second time period at which the precursor ion was transmitted by said mass analyser, a mass to charge ratio of said entire precursor ion.

10. The mass spectrometer of claim 9, wherein the time period over which the first fragment or product ion is detected only partially overlaps with the time period over which the second fragment or product ion is detected.

11. The mass spectrometer of claim 9, wherein the mass analyser that transmits the precursor ions to the fragmentation or reaction device is a mass filter.

12. The mass spectrometer of claim 9, wherein mass analyser for mass analysing the fragment or product ions is a time of flight mass analyser.

13. A method of mass spectrometry comprising:

mass selectively transmitting precursor ions into a fragmentation or reaction device; wherein first precursor ions having a first mass to charge ratio are transmitted into the fragmentation or reaction device over a first time-period and second precursor ions having a second mass to charge ratio are transmitted into the fragmentation or reaction device over a second time-period such that the time-periods overlap only in part;

fragmenting said precursor ions in the fragmentation or reaction device so as to produce fragment ions;

mass analysing said fragment ions;

determining first fragment ions and second fragment ions having different mass to charge ratios and which are produced over different time-periods that overlap only in part;

determining that the first fragment ions relate to the first precursor ions and that the second fragment ions relate to the second precursor ions by determining that the first time-period substantially coincides with the time-period over which the first fragment ions are determined to have been generated, and that the second time-period substantially coincides with the time-period over which the second fragment ions are determined to have been generated; and identifying the mass of the first precursor ions based on the first time period or identifying the mass of the second precursor ions based on the second time period.

* * * * *